US005110029A

United States Patent [19]

Blake

[11] Patent Number: 5,110,029

[45] Date of Patent: May 5, 1992

[54] BLIND RIVET SETTING TOOL WITH RIVET LOADER

[75] Inventor: Jeffrey T. Blake, New Haven, Conn.

[73] Assignee: Emhart Inc., Newark, Del.

[21] Appl. No.: 693,583

[22] Filed: Apr. 30, 1991

[51] Int. Cl.[5] ..... B21J 15/10

[52] U.S. Cl. ..... 227/112; 227/119

[58] Field of Search ..... 227/112, 119, 53, 54, 227/155, 156, 107

[56] References Cited

U.S. PATENT DOCUMENTS

| | | | |
|---|---|---|---|
| 1,202,072 | 10/1916 | Kemp | 227/53 |
| 2,593,506 | 4/1952 | Wales | 227/53 |
| 4,089,099 | 5/1978 | Nivet | 227/53 |
| 4,754,643 | 7/1988 | Weeks, Jr. et al. | 227/112 |
| 4,765,175 | 8/1988 | Denham et al. | 227/112 |
| 4,978,046 | 12/1990 | Hagman et al. | 227/119 |

*Primary Examiner*—Frank T. Yost
*Assistant Examiner*—Scott A. Smith
*Attorney, Agent, or Firm*—Spencer T. Smith

[57] ABSTRACT

The likelihood of successful transfer of a blind rivet from a loading device to the nose of a blind rivet setting tool is substantially improved by conforming the end surface of the nose which receives the blind rivet to the convex surface of the blind rivet flange which is received and by making the inner diameter of the nose bore correspond to the inner diameter of the convex rivet surface.

1 Claim, 1 Drawing Sheet

BLIND RIVET SETTING TOOL WITH RIVET LOADER

Figures 1, 2:
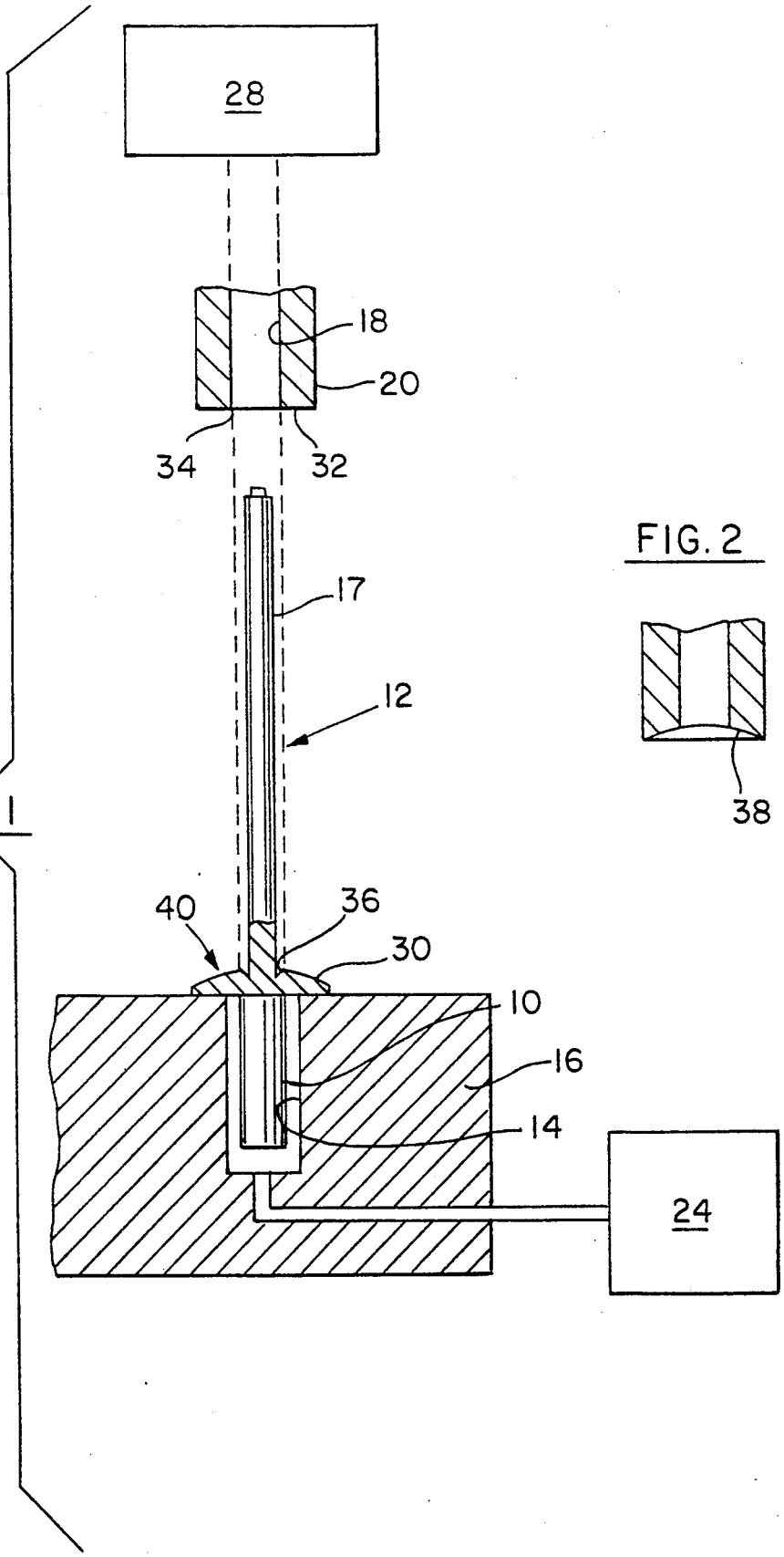
FIG. 1 (PRIOR ART)

The present invention relates to blind riveting wherein a two piece rivet having a body and a mandrel is upset by a rivet setting tool which grips the free end of the mandrel and pulls the enlarged remote end of the mandrel into the body to effectively clamp a workpiece between the flange of the body and the free end of the body which is enlarged by pulling the enlarged mandrel thereinto.

To increase the productivity of such tools loading devices are used which present the next rivet in axial alignment with and spaced from the tool and then transfer the rivet to the tool by blowing the blind rivet towards the tool. The tool nose which is under vacuum receives and holds the transferred blind rivet. Since the free end of the mandrel can be over an inch in length and since its orientation can deviate from its desired axis transfer of the rivet is not always successfully accomplished.

Men skilled in the art have confronted a predicament when attempting to increase the likelihood of rivet transfer. A chamfer around the opening of the flat ended nose portion of the tool which receives the rivet would increase the likelihood of transfer but such a chamfer is undesirable in the rivet setting operation and the larger the chamfer the more undesirable it becomes.

The inventor herein defined a solution which functions like a chamfer but is not a chamfer.

It is accordingly an object of the present invention to increase the transfer success rate in a blind rivet air transfer system without also assuming undesirable consequences.

Other objects and advantages of the present invention will become apparent from the following portion of this specification and from the accompanying drawings which illustrates in accordance with the mandate of the patent statutes a presently preferred embodiment incorporating the principles of the invention.

Referring to the drawings:

FIG. 1 is a schematic illustration of a prior art blind riveting system wherein a blind rivet is transferred from a loading device to the nose of a blind rivet setting tool by blowing the blind rivet into the nose; and FIG. 2 is a view of a portion of the system illustrated in FIG. 1 showing the change which substantially improves the likelihood of successful transfer.

In an air transfer system the body end 10 of a blind rivet 12 is received within a suitable blind bore 14 in a loading device 16. The loading device is displaced to position the projecting mandrel portion 17 of the blind rivet 12 in axial alignment with the through hole 18 in the nose 20 of a blind rivet setting tool. The body end 10 of the rivet 12, is held within the loading device blind bore 14 by vacuum defined by a pressure source 24 which can selectively apply positive pressure or a vacuum.

To transfer the rivet the pressure source 24 switches to apply positive pressure to the blind bore 14 to blow the rivet across the space between the end of the mandrel 17 and the nose 20 and into the nose bore 18 where a vacuum generated by a vacuum source 28 holds the flange 30 of the blind rivet against the flat end face 32 of the nose. It is very important that the inner edge 34 of this opening engage the inner edge 36 of the flange 30 so that the riveting operation will be effected properly without debris being generated which could foul the tool.

According to the present invention (FIG. 2) the flat end face 32 of the nose is reconfigured into a concave surface 38 which conforms to the engaged convex surface 40 of the flange. Additionally, the inner edge 36 of the convex portion of the flange 30 approximately corresponds to the inner edge 34 of the nose bore 18. This maintains the desired line of contact of the nose inner diameter with the inner diameter of the flange. The transfer success rate is substantially increased even though the edge of the nose opening is not chamfered.

I claim:

1. An automatic blind rivet setting system comprising a blind rivet setting tool for setting a blind rivet having a body portion with a convexly flanged end and a mandrel portion extending into the body portion, said blind rivet setting tool including a nose portion having an end surface, and a bore in said nose communicating with said end surface for receiving the mandrel of a blind rivet, vacuum means for establishing a vacuum in said bore for holding the mandrel portion of a blind rivet located therein, said end surface being selectively concavely contoured to correspond to the convex flange surface with the inner diameter of said concave surface substantially corresponding to the inner diameter of the convex flange surface to guide the convexly flanged end into the nose portion during rivet transfer.

a loading device including a blind bore for receiving the body portion of a blind rivet to be transferred to said nose when said loading device is located so as to present the mandrel in coaxial relation with the axis of said nose bore, and means for blowing a blind rivet received in said loading device blind bore towards said nose bore so that the mandrel will enter into said nose bore and be held therein by said vacuum means.

* * * * *